US010386037B2

(12) United States Patent
Hannula et al.

(10) Patent No.: US 10,386,037 B2
(45) Date of Patent: Aug. 20, 2019

(54) ARC LIGHT

(71) Applicant: Research & Design Innovations, LLC, Branford, CT (US)

(72) Inventors: Kevin Hannula, Bloomington, IN (US); Nick Kroes, Muskegon, MI (US); Donald Terry Allen, Madison, CT (US)

(73) Assignee: RESEARCH & DESIGN INNOVATIONS, LLC, Branford, CT (US)

( * ) Notice: Subject to any disclaimer, the term of this patent is extended or adjusted under 35 U.S.C. 154(b) by 135 days.

(21) Appl. No.: 15/606,495

(22) Filed: May 26, 2017

(65) Prior Publication Data

US 2018/0038571 A1 Feb. 8, 2018

Related U.S. Application Data

(60) Provisional application No. 62/372,064, filed on Aug. 8, 2016.

(51) Int. Cl.

| | |
|---|---|
| ***F21V 3/02*** | (2006.01) |
| ***F21V 3/06*** | (2018.01) |
| ***B63B 45/02*** | (2006.01) |
| ***B63B 45/04*** | (2006.01) |
| ***F21V 15/01*** | (2006.01) |
| ***F21V 17/10*** | (2006.01) |
| ***F21V 23/00*** | (2015.01) |

(Continued)

(52) U.S. Cl.

CPC ..... *F21S 45/50* (2018.01); *B63B 45/02* (2013.01); *B63B 45/04* (2013.01); *F21V 21/06* (2013.01); *F21V 31/04* (2013.01); *F21V 3/02* (2013.01); *F21V 3/062* (2018.02); *F21V 15/01* (2013.01); *F21V 17/101* (2013.01); *F21V 23/001* (2013.01); *F21V 23/04* (2013.01); *F21Y 2103/10* (2016.08); *F21Y 2103/30* (2016.08); *F21Y 2113/13* (2016.08); *F21Y 2115/10* (2016.08)

(58) Field of Classification Search

CPC ..... B63B 45/02; B63B 45/04; F21S 43/15; F21S 43/26; F21Y 2103/30

USPC ..... 362/477

See application file for complete search history.

(56) References Cited

U.S. PATENT DOCUMENTS 7,264,384 B1 * 9/2007 Ryan ..... B63B 17/02 362/477
9,528,238 B2 * 12/2016 Taylor ..... E02B 3/26
(Continued)

*Primary Examiner* — William N Harris
(74) *Attorney, Agent, or Firm* — DeLio Peterson & Curcio LLC; Thomas E. Ciesco

(57) ABSTRACT

An arched light source for illuminating an area comprising a base and an arched support extending from the base. The arched support has an upper edge corresponding to an arc having a center below the base and a lower edge meeting the base corresponding to a chord of the arc. The arched support includes a groove along the upper edge of the arched support. The arched light support includes a light source disposed in the groove and a transparent lens extending the length of the groove and sealing the light source within the groove. The light source may be a plurality of discrete LEDs spaced a distance apart, the plurality of LEDS extending substantially the entire length of the groove. The color emitted by the light source may be controllable by the user. The arched support may be opaque. The base may be mountable to a marine vessel.

18 Claims, 6 Drawing Sheets

(51) Int. Cl.

| | |
|---|---|
| ***F21V 23/04*** | (2006.01) |
| ***F21V 31/04*** | (2006.01) |
| ***F21Y 103/10*** | (2016.01) |
| ***F21Y 103/30*** | (2016.01) |
| ***F21Y 113/13*** | (2016.01) |
| ***F21Y 115/10*** | (2016.01) |
| ***F21S 45/50*** | (2018.01) |
| ***F21V 21/06*** | (2006.01) |

(56) References Cited

U.S. PATENT DOCUMENTS

2010/0118557 A1* 5/2010 Ortwein ..... B60Q 1/32
362/477
2014/0063827 A1* 3/2014 Ethington ..... A63J 17/00
362/477
2014/0063828 A1* 3/2014 Roach ..... B63B 35/7933
362/477

* cited by examiner

ARC LIGHT

BACKGROUND OF THE INVENTION

1. Field of the Invention

The present invention is related to light sources and specifically to light sources which may be used for illuminating parts of a marine vessel or areas adjacent to a marine vessel.

2. Description of Related Art

Lighting for marine vessels is generally provided in the manufacture of the marine vessel and are mounted flush to a surface on the marine vessel. An efficient waterproof light source which may be mounted to a marine vessel after manufacture of the marine vessel would be useful. Additionally, having a light source which can provide uniform accent lighting of an area inside or outside of the marine vessel would provide a safer environment for walking or other activities.

SUMMARY OF THE INVENTION

Bearing in mind the problems and deficiencies of the prior art, it is therefore an object of the present invention to provide a light source which provides uniform illumination of an area.

It is another object of the present invention to provide a light source mountable to a surface which provides indirect illumination of an area.

A further object of the invention is to provide an efficient light source which may be mounted to a surface.

It is yet another object of the present invention to provide an aftermarket light source for a marine vessel.

Still other objects and advantages of the invention will in part be obvious and will in part be apparent from the specification. The above and other objects, which will be apparent to those skilled in the art, are achieved in the present invention which is directed to an arched light source for illuminating an area comprising a base and an arched support extending from the base. The arched support has an upper edge corresponding to an arc having a center below the base and a lower edge meeting the base corresponding to a chord of the arc. The arched support includes a groove along the upper edge of the arched support, the groove having a groove length. The arched light support includes a light source disposed in the groove and a transparent lens extending the length of the groove and sealing the light source within the groove. The light source may be a plurality of discrete LEDs spaced a distance apart, the plurality of LEDS extending substantially the entire length of the groove. The color emitted by the light source may be controllable by the user. The arched support may be opaque. The base may be mountable to a marine vessel. The arched support arc may extend about 45 degrees and provides illumination over about 180 degrees. The lens may be substantially flush with the top surface of the arched support. The arched support may comprise a pair of side plates and a cavity between the side plates. The light source may include an angle adapter attachable to the base on an opposite surface to which the arched support extends, the adapter having a first surface parallel with the base and a second surface attachable to the marine vessel, the first surface about 45° to the second surface, wherein light from the light source is provided is shifted by about 45°. The light source may include a cable connectable to a power source for providing energy to power the light source.

Another aspect of the present invention is directed to an arched light source for illuminating an area in or adjacent a marine vessel comprising a flat base attachable to a marine vessel surface and a pair of opposing side plates extending from the base. The side plates have an arched upper edge having arch ends, the arched upper edge corresponding to an arc having a center below the base and a lower edge meeting the base corresponding to a chord of the arc. Each arched end converges on the base and the opposing side plates have a cavity therebetween. The arched light source includes an arched strut parallel with the arched upper edge, the arched strut having support ends, each strut end converging on the base, the arched strut extending between the opposing side plates. The arched light source includes a transparent lens secured to and extending the length of the arched upper edge and an elongated light source disposed between the transparent lens and the arched strut, the light source capable of providing illumination substantially from the entire transparent lens. The light source may be a plurality of discrete LEDs spaced a distance apart, the plurality of LEDS extending substantially the entire length of the arched strut. The color emitted by the light source may be controllable by the user. The opposing side plates may be opaque. The arched strut may extend an arc of about 45° and provides illumination over about 180°. The lens may be substantially flush with the top surface of the arched support. The light source may include an angle adapter attachable to the base on an opposite surface to which the side plates extend, the adapter having a first surface parallel with the base and a second surface attachable to the marine vessel, the first surface about 45° to the second surface, wherein light from the light source is provided is shifted by about 45°. The light source may include a cable connectable to a power source for providing energy to power the light source.

Another aspect of the present invention is directed to a method of using an arched light source to illuminate an area adjacent to a marine vessel surface. The method comprises providing the light source as described above and attaching the base to a surface on the marine vessel. The method includes attaching the cable to a power source or a switch attached to the power source and if the cable is attached to the switch, ensuring the switch is in an on position. The light source provides a visible light extending outward from the transparent lens, illuminating the marine vessel surface adjacent the arched light source and area near the marine vessel surface where the arched light source is disposed.

The arc light according to the present invention provides exterior and interior lighting for boats and other enclosed areas, and may be mounted under the floor or deck of a pontoon or other boat or on the underside of tables or counters for lighting regions that are otherwise in shadows from conventional lighting.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENT(S)

Figure 1:
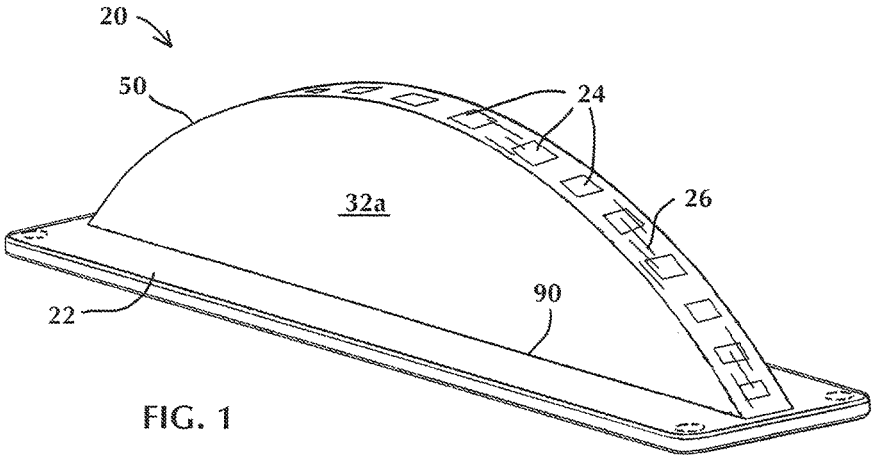
FIG. 1 is a perspective view of the arc light according to the present invention.

In describing the preferred embodiment of the present invention, reference will be made herein to FIGS. 1-11 of the drawings in which like numerals refer to like features of the invention.

As shown in FIGS. 1 and 3-9, the arc light 20 includes a rectangular base 22 which may include mounting openings 68 for fastening the base 22 to a surface of a marine vessel. A pair of arcuate side plates 32*a*, 32*b* extends from the base 22 at substantially right angles. The side plates 32 include an arc surface 50 and are preferably opaque.

Figure 2:
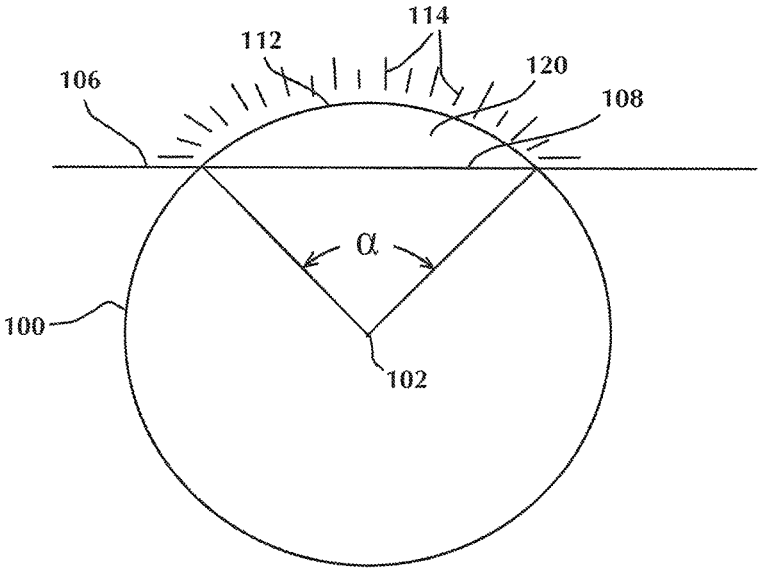
FIG. 2 is a geometrical representation of terms used in the present application as applied to the arc light shown in FIG. 1.

In describing the configuration of the arc light of the present invention, the following geometrical terms are used in describing certain features of the invention. FIG. 2 illustrates a circle 100 having a center point 102. Arc 112 is a part of the circumference of the circle, and describes the arc surface 50 of arc light 20 as seen in side view. Chord 108 of circle 100 is the straight line segment whose endpoints both lie on the circle 100, and secant 106 intersects two points on the circle 100 and chord 108, the interval of the secant 106 that lies between the points at which it intersects the circle, describes lower edge 90 of side plates 32*a*, 32*b* that meet base 22. Circular segment 120, enclosed between the chord 108 and the arc 112, describes the surface of side plates 32*a*, 32*b* as seen in side view. Circular segment 120 is a region of two-dimensional space that is bounded by an arc of less than 180°. For the present invention, the arc 112, segment 120 and chord 108, and the corresponding portions of arc light 20, may also apply to an ellipse as well as a circle. Light rays 114 emanating from a light source extending the length of the arc 112 along arc surface 50, as will be described further below, would travel in a substantially radial direction from the circle center 102 as well as along the plane of the surface to which the arc light 20 is mounted, to illuminate surfaces beyond the light source. As the angle $\alpha$ increase or the shape of the arc changes with an increase of the height to span ratio, the dispersion of the light will change, allowing more light to strike the surface to which the arc light is attached. As the angle $\alpha$ decreases or the height to span ratio decreases, less light will be directed to the surface. The height to span ratio is generally changed as the circle becomes an ellipse.

Figure 4:
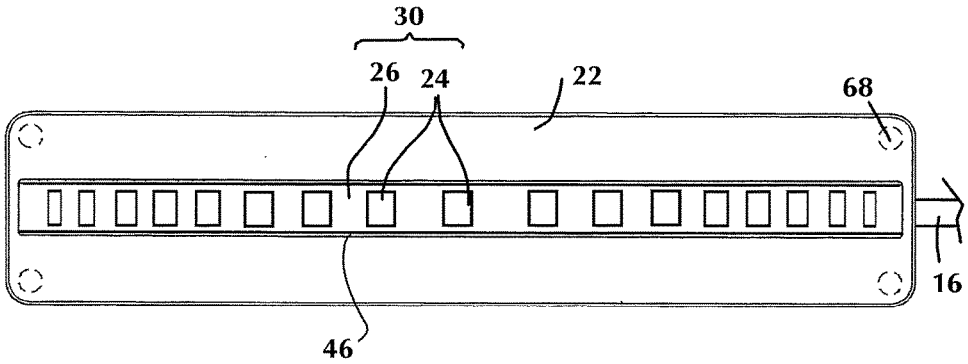
FIG. 4 is a top elevational view of the arc light shown in FIG. 1.
Figure 5:
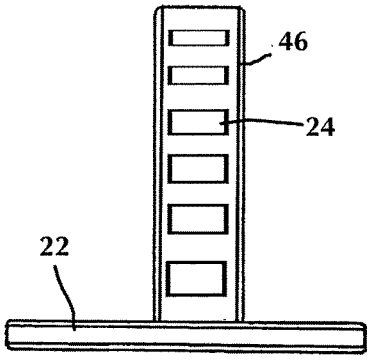
FIG. 5 is a front elevational view of the arc light shown in FIG. 1.
Figure 6:
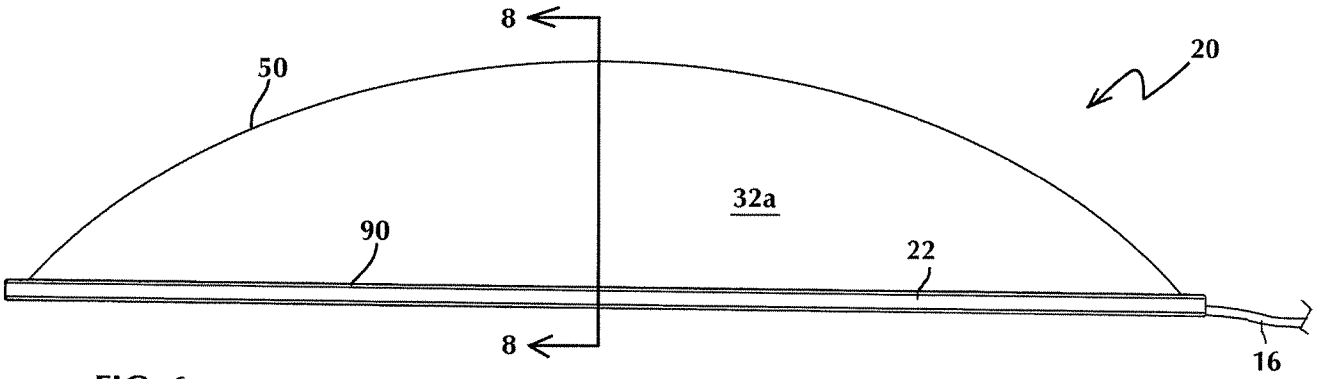
FIG. 6 is a right side elevational view of the arc light shown in FIG. 1.
Figure 7:
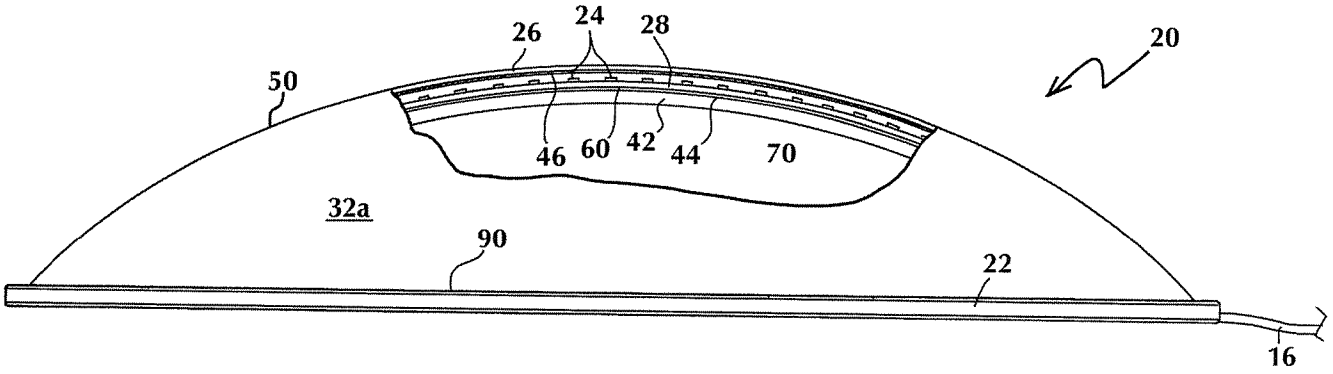
FIG. 7 is a right side cutaway view of the arc light shown in FIG. 1.
Figure 8:
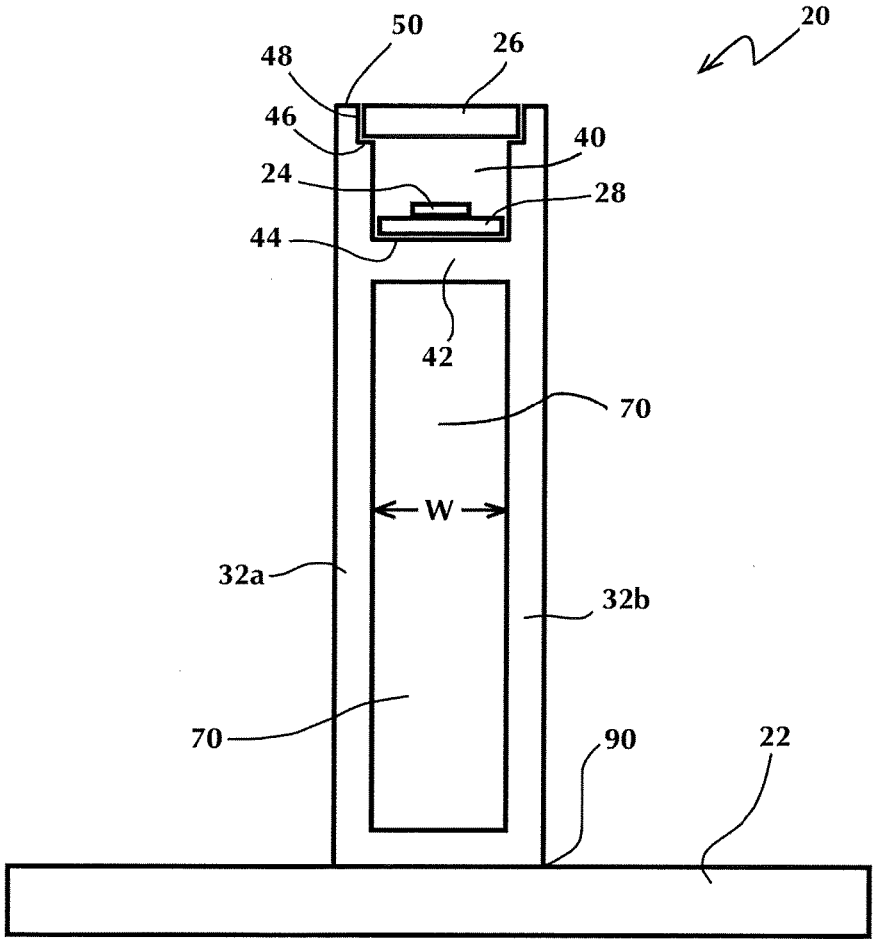
FIG. 8 is a front cross sectional view of the arc light along cut lines 8 shown in FIG. 6.
Figure 9:
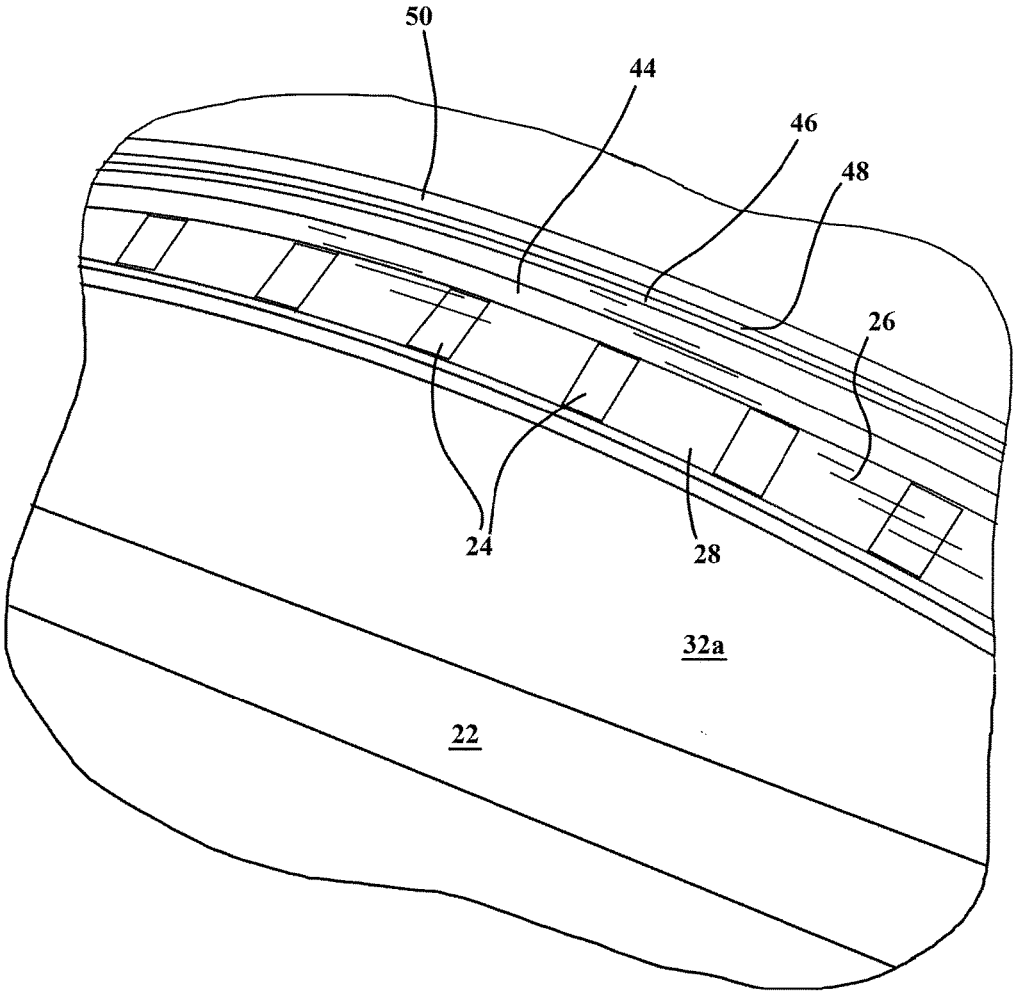
FIG. 9 is a top right perspective view of a portion of the arc light shown in FIG. 1.

The side plates 32*a*, 32*b* are disposed a distance W from each other providing a space 70 between the side plates 32*a*, 32*b*. An arched strut 44 extends between side plate 32*a* and side plate 32*b*. A cavity or groove 40 extends the length of the arc surface 50. The groove 40 includes a groove ridge 46 and a ridge side wall 48 for engaging a transparent lens 26 extending the length of the groove 40. As shown in FIG. 4, a light source 30 disposed in the groove 40 may be comprised of an LED strip base 28 and a plurality of LEDs spaced apart which are attached to the LED strip base 28. The light source 30 is disposed between the groove bottom surface 42 and the lens 26 and may extend substantially the entire length of the groove 40. The plurality of LEDs 24 may be evenly spaced along the length of the light strip base 28.

The lens 26 may be fastened to the groove ridge 46 and the ridge side wall 48 with an adhesive 60. The adhesive preferably seals the lens 26 to the groove ridge 46 so that the light source is sealed in the groove 40. The groove 40 is watertight so that the corrosive air or water in contact with the arc light 20 will not affect the electronics or light source in the arc light 20. A cavity 70 is disposed between the arched strut 42 and the arc light base 22, between side plate 32*a* and side plate 32*b*. Alternately, the cavity 70 may be omitted, with the side plate 32*a* and side plate 32*b* being one solid member incorporated with and below the arched strut 42.

The lens 26 may be a light guide made of a clear plastic strip 26 having an arched length extending from the base at one base end to the opposite base end. The lens has a width extending between opposing ridge side walls 48 and a thickness extending from the groove ridge 46 to the side plate top surface 50.

Figure 3:
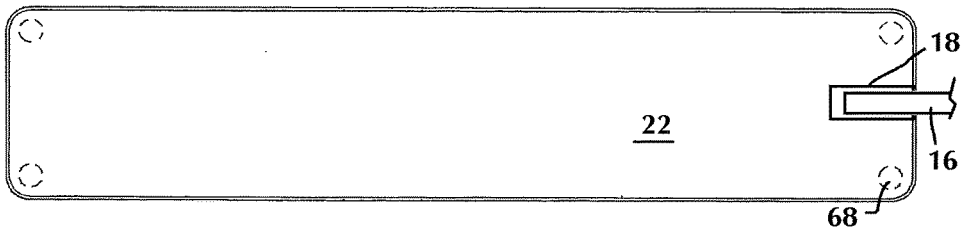
FIG. 3 is a bottom elevational view of the arc light shown in FIG. 1.

As shown in FIGS. 3 and 4, the light source 30 may be powered from an energy source by a cable 16 extending from an opening 18 disposed on the bottom surface of the rectangular base 22. The opening is sealed between the cable 16 and the opening 18 to prevent water or air from entering the arc light 20. The cable 16 is attached to the light source 30 between the side plate 32*a* and side plate 32*b*. The cable may be multi-conductor to provide separate energy sources for red, green and blue components in the LED light strip.

In an example of the arc light, the arc light 20 may comprise a flat rectangular base 22 on which is mounted an arcuate-shaped RGB (red-green-blue) LED light strip 24. The strip 24 may have a narrower width, for example, in the range of about 0.3 to 0.6 in. width, and a longer length, for example about 5 to 10 in. length. The LED light strip 24 has ends at the level of base 22 and in its mid portion extends above base 22 in an arcuate configuration, for example, with a radius in the range of about 3 to 6 in. as shown in the side view of FIG. 2.

Figure 10:
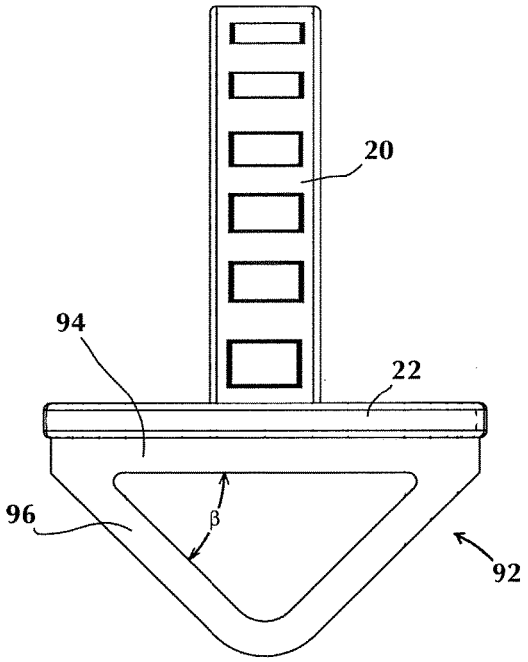
FIG. 10 is a first embodiment of an angle adapter for mounting the arc light on a surface.
Figure 11:
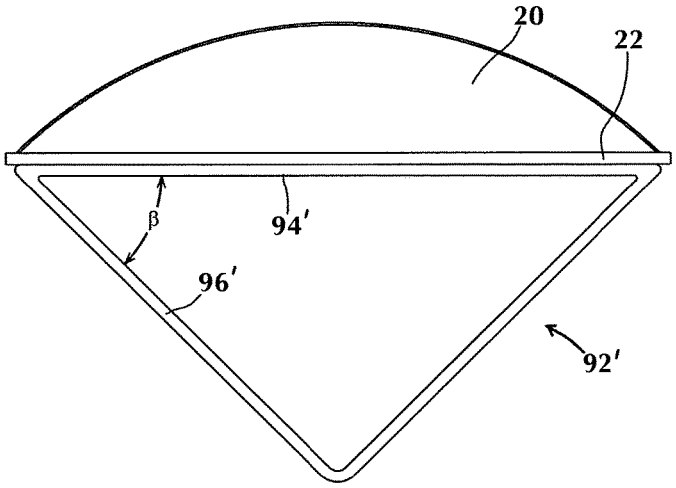
FIG. 11 is a second embodiment of an angle adapter for mounting the arc light on a surface.

FIGS. 10 and 11 show the arc light 20 and angle adapter 92, 92'. The lens 26 has a length in the direction parallel to the arc direction and a width perpendicular to the length. The angle adapter 92 allows the arc light to be mounted with the lens shifted in a direction parallel with the lens length. The angle adapter 92' allows the arc light to be mounted with the lens shifted in a direction perpendicular with the lens length. A first plate 94, 94' is attachable to the arc light base 22 and a second plate 96, 96' is attachable to a surface such as the surface of a marine vessel. The first plate 94, 94' is at an angle $\beta$ from second plate 96, 96', the angle shown in the drawings being about 45. The angle may be larger or smaller, depending on the amount of shift in which the manufacturer wants to provide.

Opaque side plates 32*a*, 32*b* are disposed on either side of the light strip and extend from the lens 26 to the base 22, and have a flat lower edge secured to the flat base 22 along chord 90 and an arcuate upper edge 50 to match the curvature of the lens 26. The light 114 is directed outwardly from light source 30 in a radial direction, emanating from the center 102 of the arc 106 corresponding to the curvature of upper edge 50 as well as along the plane of the surface to which the arc light 20 is mounted, and in the longitudinal direction of the length of the strip. The light emanating in the side directions is minimized by the opaque side plates 32*a*, 32*b*.

When mounted under a floor or deck of a pontoon or other boat, the arcuate shape extends straight downward toward the pontoon flotation tube, hull and/or surface of the water. When the base is mounted to the underside of a table, ledge or counter structure, the arcuate shape extends straight downward toward the floor. The light from light strip 24 passed through lens 26 is directed downward to illuminate in a pattern that extends the emitted visible light in the longitudinal direction of the light strip 24. The RGB light strip may be controlled to change the color of the emitted light as desired.

The objects of the present invention laid out in the Summary of the Invention above have each been met, including providing a light source mountable to a surface which provides indirect illumination of an area, providing an efficient light source which may be mounted to a surface, and providing an aftermarket light source for a marine vessel.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. An arched light source for illuminating an area comprising:

a base;

an arched support extending from the base, the arched support having an upper edge corresponding to an arc having a center below the base and a lower edge meeting the base corresponding to a chord of the arc, and including a groove along the upper edge of the arched support, the groove having a groove length;

a light source disposed in the groove;

a transparent lens extending the length of the groove and sealing the light source within the groove; and an angle adapter attachable to the base on an opposite surface to which the arched support extends, the adapter having a first surface parallel with the base and a second surface attachable to a marine vessel, the first surface about 45° to the second surface, wherein the angle adapter causes light from the light source to be shifted by about 45°.

2. The light source of claim 1 wherein the light source is a plurality of discrete LEDs spaced a distance apart, the plurality of LEDS extending substantially the entire length of the groove.

3. The light source of claim 1 wherein a color emitted by the light source is controllable by the user.

4. The light source of claim 1 wherein the arched support is opaque.

5. The light source of claim 1 wherein the base is mountable to a marine vessel.

6. The light source of claim 1 wherein the arched support arc extends about 45 degrees and provides illumination over about 180 degrees.

7. The light source of claim 1 wherein the lens is substantially flush with a top surface of the arched support.

8. The light source of claim 1 wherein the arched support comprises a pair of side plates and a cavity between the side plates.

9. The light source of claim 1, including a cable connectable to a power source for providing energy to power the light source.

10. An arched light source for illuminating an area in or adjacent a marine vessel comprising:

a flat base attachable to a marine vessel surface;

a pair of opposing side plates extending from the base, the side plates having an arched upper edge having arch ends, the arched upper edge corresponding to an arc having a center below the base and a lower edge meeting the base corresponding to a chord of the arc, each arch end converging on the base, the opposing side plates having a cavity therebetween;

an arched strut parallel with the arched upper edge, the arched strut having support ends, each support end converging on the base, the arched strut extending between the opposing side plates;

a transparent lens secured to and extending a length of the arched upper edge; and an elongated light source disposed between the transparent lens and the arched strut, the light source capable of providing illumination substantially from the entire transparent lens.

11. The light source of claim 10 wherein the light source is a plurality of discrete LEDs spaced a distance apart, the plurality of LEDS extending substantially the entire length of the arched strut.

12. The light source of claim 10 wherein a color emitted by the light source is controllable by the user.

13. The light source of claim 10 wherein the opposing side plates are opaque.

14. The light source of claim 10 wherein the arched strut extends an arc of about 45° and provides illumination over about 180°.

15. The light source of claim 10 wherein the lens is substantially flush with a top surface of the arched upper edge.

16. The light source of claim 10 including an angle adapter attachable to the base on an opposite surface to which the side plates extend, the adapter having a first surface parallel with the base and a second surface attachable to the marine vessel, the first surface about 45° to the second surface, wherein the angle adapter causes light from the light source to be shifted by about 45°.

17. The light source of claim 10, including a cable connectable to a power source for providing energy to power the light source.

18. A method of using an arched light source to illuminate an area adjacent to a marine vessel surface comprising:

providing the light source according to claim 17;

attaching the base to a surface on the marine vessel;

attaching the cable to a power source or a switch attached to the power source; and if the cable is attached to the switch, ensuring the switch is in an on position;

wherein the light source provides a visible light extending outward from the transparent lens, illuminating the marine vessel surface adjacent the arched light source and area near the marine vessel surface where the arched light source is disposed.

* * * * *